US008042238B2

(12) United States Patent
Pferdehirt

(10) Patent No.: US 8,042,238 B2
(45) Date of Patent: Oct. 25, 2011

(54) SNAP FASTENER PART

(75) Inventor: Thomas Pferdehirt, Wuppertal (DE)

(73) Assignee: YKK Corporation, Tokyo (JP)

( * ) Notice: Subject to any disclaimer, the term of this patent is extended or adjusted under 35 U.S.C. 154(b) by 295 days.

(21) Appl. No.: 12/517,645

(22) PCT Filed: Mar. 6, 2008

(86) PCT No.: PCT/JP2008/054548

§ 371 (c)(1),
(2), (4) Date: Jun. 4, 2009

(87) PCT Pub. No.: WO2008/111622

PCT Pub. Date: Sep. 18, 2008

(65) Prior Publication Data

US 2010/0071175 A1 Mar. 25, 2010

(30) Foreign Application Priority Data

Mar. 8, 2007 (DE) ..... 10 2007 011 420

(51) Int. Cl.
*A44B 17/00* (2006.01)

(52) U.S. Cl. ..... 24/692; 24/671; 24/674; 24/681

(58) Field of Classification Search ..... 24/682.1, 24/681, 691, 671, 662, 664, 674, 676, 108, 24/106, 113 MP, 692, 680
See application file for complete search history.

(56) References Cited

U.S. PATENT DOCUMENTS 745,089 A * 11/1903 Yeomans ..... 24/680
746,616 A * 12/1903 Washburne ..... 24/691
834,035 A * 10/1906 Washburne ..... 24/671
2,129,825 A * 9/1938 Dews ..... 24/680
2,509,434 A * 5/1950 Huelster ..... 24/692
2,626,441 A * 1/1953 Van Buren, Jr. ..... 24/676
2,626,442 A * 1/1953 Blazej ..... 24/676

FOREIGN PATENT DOCUMENTS

DE 33 12974 A1 10/1984
JP Y1 33-12116 8/1958
JP U4-31510 3/1992

* cited by examiner

*Primary Examiner* — Robert Sandy
*Assistant Examiner* — Rowland D Do
(74) *Attorney, Agent, or Firm* — Alston and Bird, LLP

(57) ABSTRACT

Snap fastener part comprising an axis (30), a coupling means (10) for coupling with a complementary coupling means of the other snap fastener part, a fixing means (14) for fixing the coupling means (10) to a carrier material (32), a cap (12) for covering the coupling means (10) on a side facing away from the carrier material (32) and a protrusion (28) on the side of the coupling means (10) facing away from the carrier material (32), said protrusion (28) encircling the axis (30), the fixing means (14) comprising at least one leg (16, 18, 20, 22, 24) which engages behind the coupling means (10) on the side facing away from the carrier material (32) when assembled and which is placed between the surface of the coupling means (10) facing away from the carver material (32) and the cap (12). According to the invention the protrusion (28) is broken by the leg (16, 18, 20, 22, 24) and the surface of the protection facing away from the carrier material (32) is flush with the surface of the leg (16, 18, 20, 22, 24) facing away from the carrier material or surmounts it.

9 Claims, 3 Drawing Sheets

SNAP FASTENER PART

FIELD OF INVENTION

The present invention relates to a snap fastener part, and particularly a snap fastener part comprising an axis, a coupling means for coupling with a complementary coupling means of the other snap fastener part, a fixing means for fixing the coupling means to a carrier material, a cap for covering the coupling means on a side facing away from the carrier material and a protrusion on the side of the coupling means facing away from the carrier material, said protrusion encircling the axis, the fixing means comprising at least one leg which engages behind the coupling means on the side facing away from the carrier material when assembled and which is placed between the surface of the coupling means facing away from the carrier material and the cap.

BACKGROUND OF THE INVENTION

Snap fastener parts of the aforementioned kind are known, for example, from DE 33 12 974 A1. According to this document, the clamping means has six legs. The cap is supported by the legs since the legs cover the protrusion on the side facing away from the carrier material. Therefore the cap is only supported in axial direction in six places, but not between said places.

The lacking support of the cap between the legs of the clamping means may result in deformation of the cap, especially when pressure is exerted on the snap fastener while ironing or mangling the piece of clothing to which the snap fastener is mounted. This especially applies when using industrial washing plants with de-watering presses and ironing or mangling machines.

It is an object of the invention to improve the snap fastener part of the aforementioned kind in such a way that any unintentional deformation of the cap is not to be feared any longer.

SUMMARY OF DISCLOSURE

According to the invention, with regard to the snap fastener part of the aforementioned kind the above object is achieved in that the protrusion is broken by the leg and the surface facing away from the carrier material is flush with the surface of the leg facing away from the carrier material or surmounts it. Specifically, a snap fastener part according to the present invention comprises an axis; a coupling means for coupling with a complementary coupling means of the other snap fastener part; a fixing means for fixing the coupling means to a carrier material; a cap for covering the coupling means on a side facing away from the carrier material and a protrusion on the side of the coupling means facing away from the carrier material, said protrusion encircling the axis; said fixing means comprising at least one leg which engages behind the coupling means on the side facing away from the carrier material when assembled and which is placed between the surface of the coupling means facing away from the carrier material and the cap; characterized in that the protrusion is broken by the leg and the surface facing away from the carrier material is flush with the surface of the leg facing away from the carrier material or surmounts it.

In other words the leg does not extend beyond the protrusion, but breaks the protrusion. Since, at the same time, the protrusion is flush with the leg or even surmounts it, the protrusion may serve for supporting the cap, thereby excluding any unintentional deformation of the cap. In the ideal case, that is when the surface of the protrusion is flush with the surface of the leg and when the protrusion forms a closed circle—apart from the through holes of the legs—, this results in an annularly closed support of the cap so that deformations are excluded in a reliable way.

In order to guarantee that the mentioned support exists in every operational state, according to a preferred embodiment of the invention the cap rests against the surface of the protrusion facing away from the carrier material.

In order to protect the coupling means preferably made of plastic material against adverse effects, especially against those adverse effects arising from ironing and mangling, it is preferred according to the invention that the surface of the coupling means facing away from the carrier material does not extend beyond the cap at any place. Thereby it is prevented, for example, that an iron gets in touch with the coupling means and starts to melt According to the invention, the coupling means has an area of a reduced thickness which is penetrated by the leg during assembly.

Thereby the coupling means and the fixing means can be assembled around the axis in every position of rotation.

For the same reason, according to an embodiment of the invention it is preferred that the protrusion is penetrated by the leg during assembly.

In order to make the snap fastener visually inconspicuous on the one hand and to keep the adverse effects arising during ironing or mangling extremely low on the other hand, it is preferred that the thickness of an assembly comprising said metal cap and said plastic part in axial direction is 2.4 mm or less.

Further, it is preferred that the snap fastener part is a female snap part.

In the following, the invention is described by means of a preferred embodiment and with reference to the enclosed drawing. In detail,

DETAILED DESCRIPTION OF PREFERRED EMBODIMENTS

Figure 1:
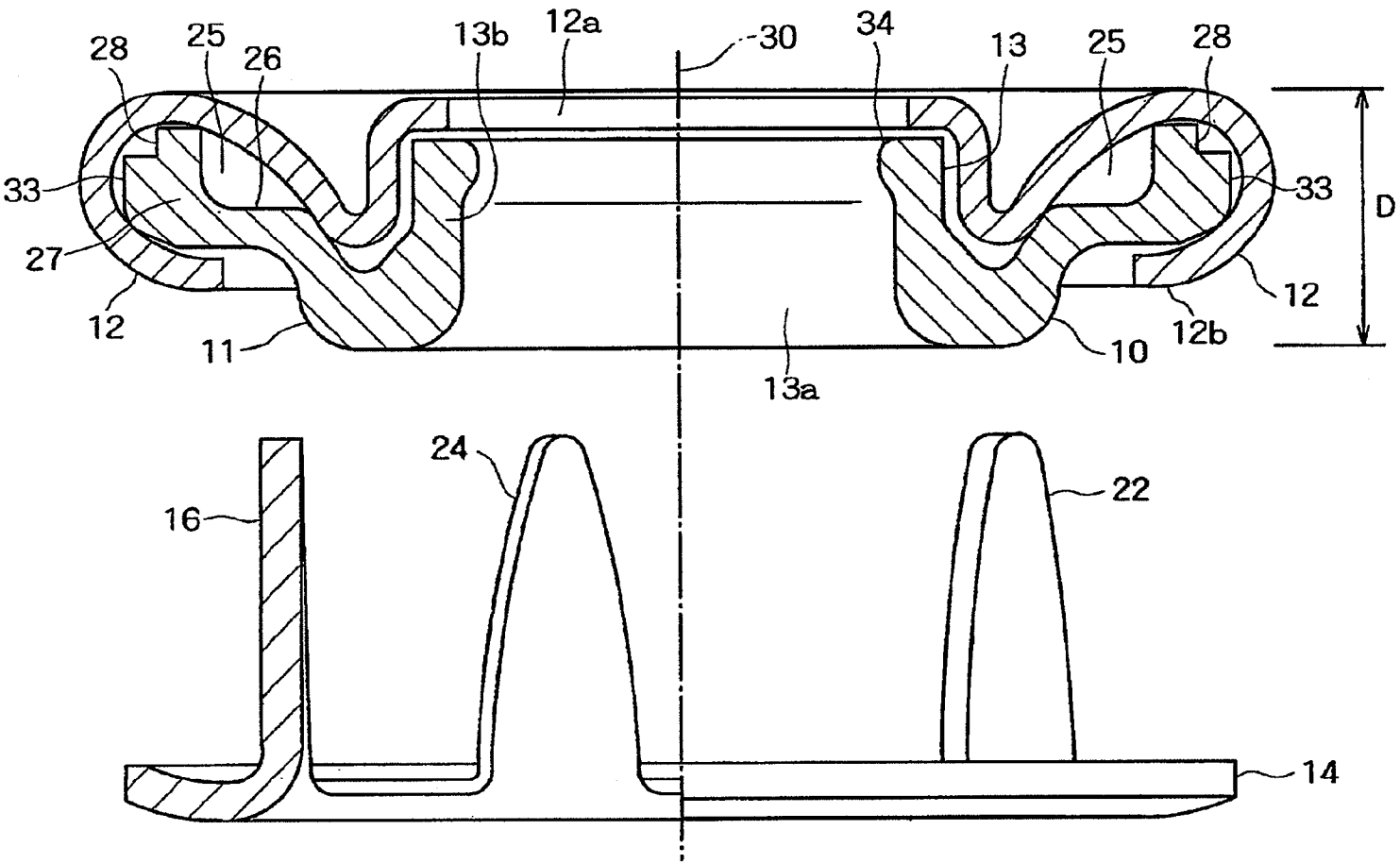
FIG. 1 shows a partially sectional exploded view of an embodiment of the snap fastener part according to the invention.
Figure 2:
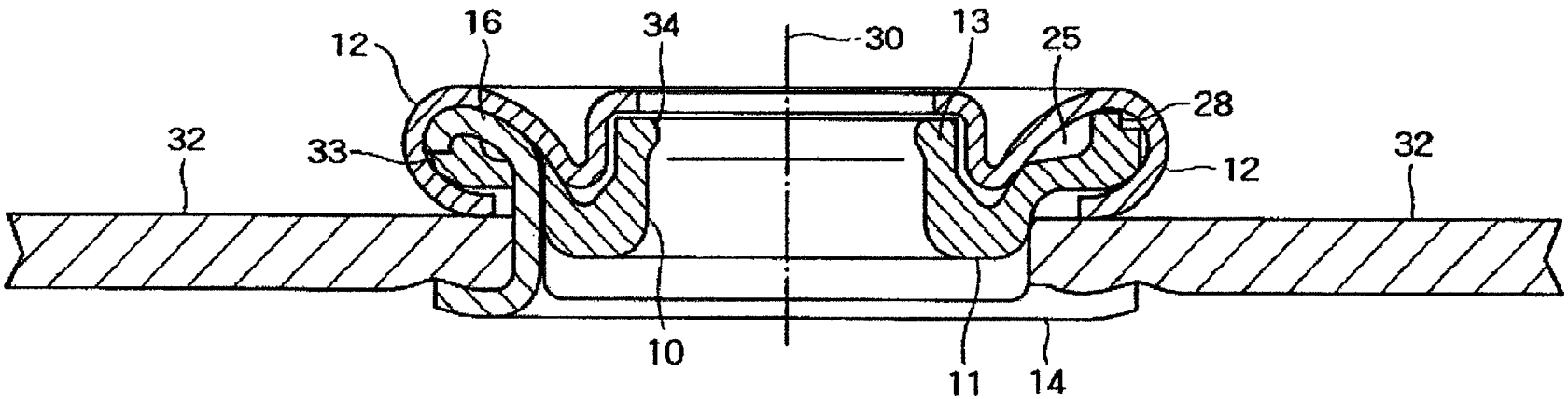
FIG. 2 shows the snap fastener part according to FIG. 1 when assembled.
Figure 3:
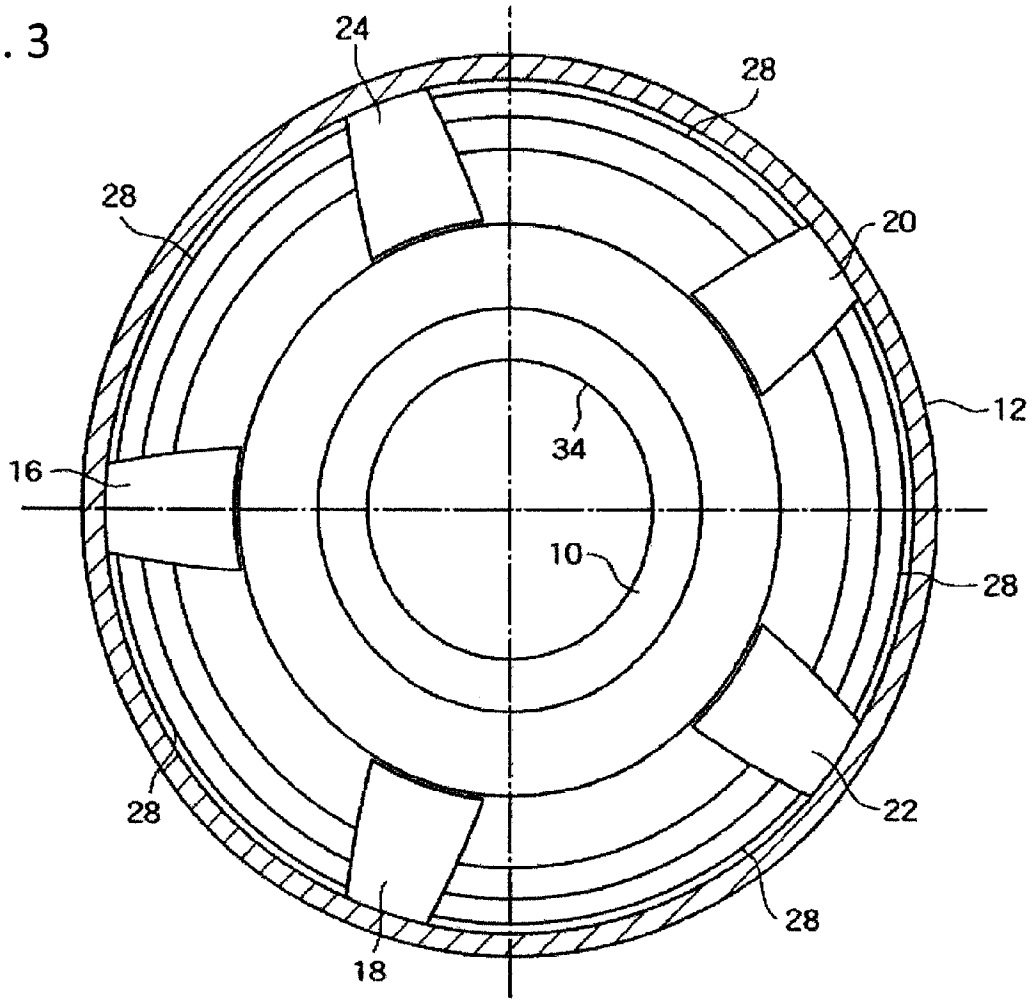
FIG. 3 shows a partially sectional plan view of the snap fastener part according to FIGS. 1 and 2.

A snap fastener part according to a preferred embodiment of the invention shown in FIGS. 1 through 3, comprises a plastic part 10 serving as a coupling means to couple with a complementary coupling means of the other part of the snap fastener, a metal cap 12 fastened to the plastic part 10 so as to cover the front surface or the surface of the plastic part 10 facing away from the carrier materials 32 and a metal pronged ring 14 serving as a fixing means to fix the plastic part 10 to the carrier materials 32 and having legs 16, 18, 20, 22 and 24. The snap fastener part shown here is a female snap part.

The plastic part 10 comprises a disk-like body 11 extending radially around the axis 30. The disk-like body 11 has an aperture 13*a* formed centrally thereof and a wall 13*b* provided around the aperture 13*a* so as to protrude axially from the front surface of the disk-like body 11. The aperture 13*a* and the wall 13*b* compose a cylindrical part 13. The disk-like body 11 also includes a reduced-thickness area 26 which is disposed radially outside the cylindrical part 13 and is of reduced thickness axially. The disk-like body 11 further includes an increased-thickness area 27 which is disposed radially outside the reduced-thickness area 26 and is thicker axially than the reduced-thickness area 26. A protrusion 28 is provided on the front surface of the increased-thickness area 27 so as to protrude axially therefrom. The cylindrical part 13, the reduced-thickness area 26, the increased-thickness area 27 and the protrusion 28 are all disposed concentrically around the axis 30, are formed integrally with each other, and each being continuous circumferentially or in circumferential direction.

The metal cap 12 is fastened to the front side of the plastic part 10. The metal cap 12 has a hole 12*a* formed centrally thereof in such a way that the hole 12*a* comes into registry with the aperture 13*a* formed centrally through the disk-like body 11 of the plastic part 10. The hole 12*a* is formed greater in diameter than the aperture 13*a* of the plastic part 10. The metal cap 12 is mounted on the plastic part 10 so as to cover the front surfaces of the reduced-thickness area 26, the increased thickness area 27 and the protrusion 28 and define with the reduced-thickness area 26 a space 25 through which prongs or legs 16, 18, 20, 22 and 24 of the pronged ring 14 are allowed to pass. The outer peripheral edge 12*b* of the metal cap 12 extends beyond the radially outermost edge 33 of the disk-like body 11 of the plastic part 10, is folded back upon the rear side of the outermost edge 33 of the plastic part 10, and firmly clamps the outermost edge 33, so that the metal cap 12 is securely fastened to the plastic part 10 against separation therefrom, to thus provide a primary assembly.

The female snap part shown in FIGS. 1 through 3 is assembled and firmly secured to the carrier material 32 by joining the thus provided primary assembly and the prong ring 14 with the carrier material 32 clamped therebetween. Specifically, the primary assembly and the pronged ring 14 are joined in the following way:

The pronged ring 14 on the one hand and the plastic part 10 and the metal cap 12 joined as the primary assembly on the other hand are arranged on opposite or front and rear sides of a carrier material 32. Thereupon, they are moved towards each other. Thus, the tips of the prongs 16 to 24 penetrate the reduced thickness area 26 and pass into the space 25 defined by and between the metal cap 12 and the reduced-thickness area 26. Then, the prongs 16 through 24 abut upon the rear surface of the metal cap 12 facing the front surface of the plastic part 10 and are bent along the rear surface of the metal cap 12 in radially outwardly. A further moving against each other of the metal cap 12 and the plastic part 10 on the one hand and the pronged ring 14 on the other hand causes the prongs 16 through 24 already passing through the reduced thickness area 26 to pass deeply into the space 25 defined between the metal cap 12 and the reduced thickness area 26 by further length, so that tips of the prongs 16 through 24 break and penetrate the protrusion 28. The final position that the prongs 16 through 24 assume is shown on the left hand side of FIG. 2 for the example of leg 16, in which the tips of the prongs 16 through 24 penetrating the protrusion 28 reach the outermost edge 33 of the disk-like body 11 and is retained between the metal cap 12 and the increased-thickness area 17 of the plastic part 10. Although the tips of the prongs 16 through 24 preferably penetrate through the protrusion 28 and reach the outermost edge 33 of the disk-like body 11 as shown here, they may only break the protrusion 28 and wedge therein. In other words, the tips of the prongs 16 through 24 do not necessarily need penetrate through the protrusion 28 nor reach the outermost edge 33 of the disk-like body 11. At the final position of the prongs 16 through 24, the front surface of the protrusion 28 which faces the rear surface of the metal cap 12 is flush with or surmounts the front surfaces of the prongs 16 through 24 which face the rear surface of the metal cap 12 in the direction of axis The right hand side of FIG. 2 dearly shows places where none of legs 16 to 24 are present. In such places, the front surface of the protrusion 28 or its surface facing away from the carrier material 32 abuts upon the rear surface of the metal cap 12, so that the protrusion 28 disposed so as to encircle the axis 30 supports the metal cap 12 over a broad circumferential or annular area, so that, even if severe pressures are exerted upon the front surface of the metal cap 12, the metal cap 12 is fully prevented from deformations.

If the front surfaces of the prongs 16 through 24 are flush with the front surface of the protrusion 28 in their final positions, the front surfaces of the prongs 16 through 24 as well as the protrusion 28 abut the rear surface of the metal cap 12. With this construction, the metal cap 12 is supported annually by both the protrusion 28 and the prongs 16 through 24, so that the metal cap 12 is fully prevented against deformation under severe pressures exerted from the-front side.

As can especially be gathered from FIGS. 1 and 2, the front surface of the plastic part 10 or its surface facing away from the carrier material 32 does not extend axially outwardly beyond the front surface of the metal cap 12 in any place. This is especially true for the radially innermost edge 34 of the disk-like body 11 of the plastic part 10 which, though it is visible in the plan view according to FIG. 3., cannot be reached, for example, by an iron while ironing because the metal cap 12 extends axially outwardly beyond the radially innermost edge 34 of the plastic part 10 at this place.

As shown in FIG. 1, the above-mentioned primary assembly comprising the plastic part 10 and the metal cap 12 has a very small thickness D when comparing it to the prior art. In the embodiment shown it only is 2.3 mm. According to the invention it does not exceed 2.4 mm. It even does not increase during assembly because, according to the above explanations, the legs 16 to 24 do not move between the protrusion 28 and the metal cap 12; rather, they break and penetrate the protrusion 28.

INDUSTRIAL APPLICABLITY

The snap fastener part according to the present invention will never result in deformation of its cap, even if severe pressure is exerted on the snap fastener while ironing or mangling the piece of clothing to which the snap fastener is mounted. This invention is especially applicable for example in industrial washing plants with de-watering presses and ironing or mangling machines.

Although the description above contains many specificities, these should not be construed as limited the scope of the invention but as merely providing illustrations of some of the presently preferred embodiments of this invention.

Thus the scope of the invention should be determined by the appended claims and their legal equivalents, rather than by the examples given.

The invention claimed is:

1. A snap fastener part comprising an axis;

a coupling means for coupling with a complementary coupling means of the other snap fastener part;

a fixing means for fixing the coupling means to a carrier material;

a cap for covering the coupling means on a side facing away from the carrier material and a protrusion on the side of the coupling means facing away from the carrier material, said protrusion encircling the axis;

said fixing means comprising at least one leg which engages behind the coupling means on the side facing away from the carrier material when assembled and which is placed between the surface of the coupling means facing away from the carrier material and the cap; and wherein the protrusion is broken by the leg and the surface of the protrusion facing away from the carrier material is flush with the surface of the leg facing away from the carrier material or surmounts it.

2. Snap fastener part according to claim 1, wherein the cap abuts on the surface of the protrusion facing away from the carrier material.

3. Snap fastener part according to claim 1, wherein the surface of the coupling means facing away from the carrier material does not extend beyond the cap at any place.

4. Snap fastener part according to claim 1, wherein the coupling means has an area of reduced thickness which is penetrated by the leg during assembly.

5. Snap fastener part according to claim 1, wherein the protrusion is penetrated by the leg during assembly.

6. Snap fastener part according to claim 1, wherein the cap is made of metal.

7. Snap fastener part according to claim 1, wherein the fixing means is made of metal.

8. Snap fastener part according to claim 1, wherein the thickness (D) of an assembly comprising said metal cap and said plastic part is 2.4 mm or less in, axial direction.

9. Snap fastener part according to claim 1, wherein the snap fastener part is a female snap part.

* * * * *